US007473137B2

(12) United States Patent
Cai et al.

(10) Patent No.: US 7,473,137 B2
(45) Date of Patent: Jan. 6, 2009

(54) RIGHT-ANGLE COAXIAL CONNECTOR

(75) Inventors: Xingjian Cai, Gilbert, AZ (US); Ke Wang, Laveen, AZ (US); Mike Castillo, Hillsboro, OR (US)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 11/694,203

(22) Filed: Mar. 30, 2007

(65) Prior Publication Data

US 2008/0242120 A1 Oct. 2, 2008

(51) Int. Cl.
*H01R 13/648* (2006.01)

(52) U.S. Cl. ..... 439/608; 439/581

(58) Field of Classification Search ..... 439/608, 439/581

See application file for complete search history.

(56) References Cited

U.S. PATENT DOCUMENTS 4,861,271 A * 8/1989 Bogar et al. ..... 439/63
4,900,258 A * 2/1990 Hnatuck et al. ..... 439/63
5,169,343 A * 12/1992 Andrews ..... 439/608
5,197,893 A * 3/1993 Morlion et al. ..... 439/101
5,334,050 A * 8/1994 Andrews ..... 439/579
5,507,655 A * 4/1996 Goerlich ..... 439/108
5,516,294 A * 5/1996 Andrews et al. ..... 439/63
5,516,307 A * 5/1996 Cartesse et al. ..... 439/581
5,577,935 A * 11/1996 Harting et al. ..... 439/581
5,613,880 A * 3/1997 Wang ..... 439/620.03
5,743,765 A * 4/1998 Andrews et al. ..... 439/608
5,851,121 A * 12/1998 Thenaisie et al. ..... 439/63
RE36,065 E * 1/1999 Andrews et al. ..... 439/608
5,943,770 A * 8/1999 Thenaisie et al. ..... 29/883
6,071,127 A * 6/2000 Acke et al. ..... 439/63
6,257,927 B1 * 7/2001 Suzuki et al. ..... 439/579
6,305,947 B1 * 10/2001 Bruce ..... 439/63
6,491,545 B1 * 12/2002 Spiegel et al. ..... 439/579
6,575,761 B1 * 6/2003 Regnier ..... 439/63
6,719,586 B2 * 4/2004 Weidner ..... 439/581
6,776,621 B1 * 8/2004 Dye ..... 439/63
6,808,414 B2 * 10/2004 Spiegel et al. ..... 439/579
6,905,367 B2 * 6/2005 Crane et al. ..... 439/608
6,910,897 B2 * 6/2005 Driscoll et al. ..... 439/65
6,948,977 B1 * 9/2005 Behrent ..... 439/581
7,101,191 B2 * 9/2006 Benham et al. ..... 439/65
7,118,381 B2 * 10/2006 Weidner ..... 439/63
2003/0203677 A1 * 10/2003 Spiegel et al. ..... 439/608
2004/0014360 A1 * 1/2004 Crane et al. ..... 439/608

* cited by examiner

*Primary Examiner*—Ross N Gushi
(74) *Attorney, Agent, or Firm*—Grossman, Tucker, Perreault & Pfleger, PLLC

(57) ABSTRACT

An electrical connector and connection system are disclosed having an array of conductive coaxial pairs. Each pair consists of a cylindrical electrical conductor surrounded by a tubular electrically conductive shield with a dielectric insulator disposed there-between. A rigid connector housing contains the coaxial pairs in a fixed spaced parallel relationship. The housing has first and second interfaces relatively disposed at a right angle, and the conductors and shields each have connector pins extending from said interfaces for connection to a printed circuit board or a connector base. The coaxial pairs follow parallel curvilinear paths between the interfaces having two consecutive bends of forty-five angular degrees.

10 Claims, 6 Drawing Sheets

RIGHT-ANGLE COAXIAL CONNECTOR

FIELD

The present disclosure is related to a connector for coaxial lines between circuit boards disposed at right angles. More specifically, the present disclosure is related to IEEE802.3ap ad-hoc modeling technology, Advanced Tele-Communication Architecture (ATCA), and high-speed platform connectors, in high-speed platforms.

BACKGROUND

In modern communication systems, where data rates are approaching dozens of gigabits per second, the interface connector becomes critical to the overall interface performance. The electrical field distortion and radiation loss of existing interface connectors often dramatically degrade channel performance, especially in high speed platforms. In some cases, the entire interface cannot meet required specifications even after applying advanced signaling techniques such as de-emphasis in the transmitter buffer and equalization in the receiver buffer. There exists a call for a coaxial connector configured for implementation in high-speed existing platforms which does not have or create such drawbacks and inefficiencies.

BRIEF DESCRIPTION OF THE DRAWINGS

A connector for coaxial lines between circuit boards disposed at right angles should become apparent from a reading of the ensuing description together with the drawings, in which.

Although the following Detailed Description will proceed with reference being made to these illustrative embodiments, many alternatives, modifications, and variations thereof will be apparent to those skilled in the art. Accordingly, it is intended that the claimed subject matter be viewed broadly.

DETAILED DESCRIPTION

Figure 1:
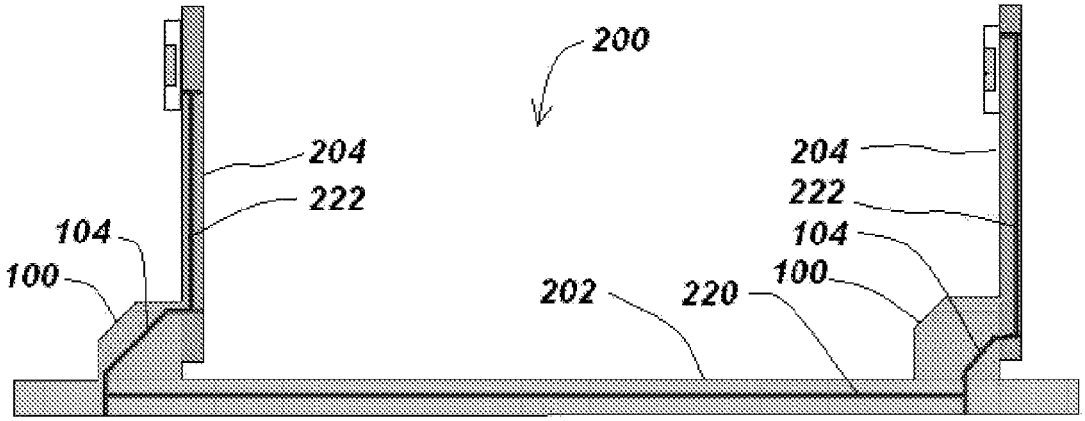
FIG. 1 is a side view of a mother board connected to two daughter boards through connectors according to the disclosure.
Figure 2:
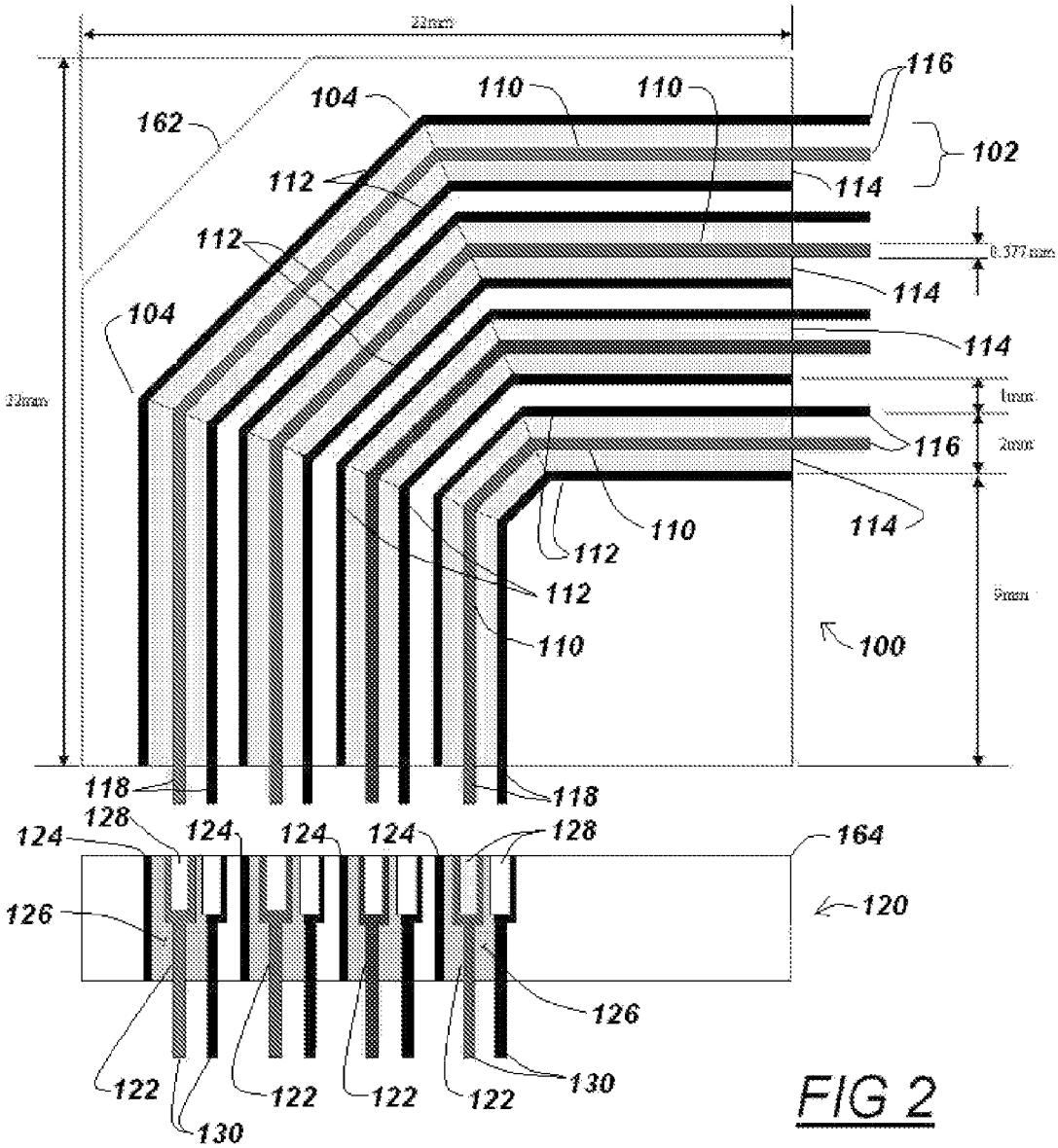
FIG. 2 is a dimensioned cross-sectional side view of a 4× connector and connector base according to the disclosure.

The right-angle coaxial connectors of FIGS. 1 through 4 provide a hardware structure which improves high-speed channel performance in both the frequency and time domains for high-speed interfaces. FIGS. 1 and 2 show a 4× connector 100 having four conducting lines 102 per column. Typical conducting line 102 is curved in two forty-five angular degree bends 104, to effectively bend the conducting line a total of ninety angular degrees without a sharp and inefficient ninety angular degree bend common to existing connectors. Implementation of this connector is found to eliminate the radiation losses and cross talk between interface and non-interface signals found in existing connectors. A connector such as connector 100 may support differential signaling beyond 80 Gbps.

For short backplane interfaces, connector 100 achieves a cost-effective solution to the inefficiencies and drawbacks of existing connectors by eliminating the need for a complex equalization scheme. For long backplane interfaces, connector 100 may be used together with simple equalization methods to improve the signaling performance at a lower cost than would otherwise be achieved.

FIG. 1 depicts a typical high-speed channel 200 in a generic high-speed communication system, using connectors according to the disclosure. Channel 200 includes a printed mother board 202, two connectors 100 according to the disclosure, and two daughter boards 204.

Figure 3:
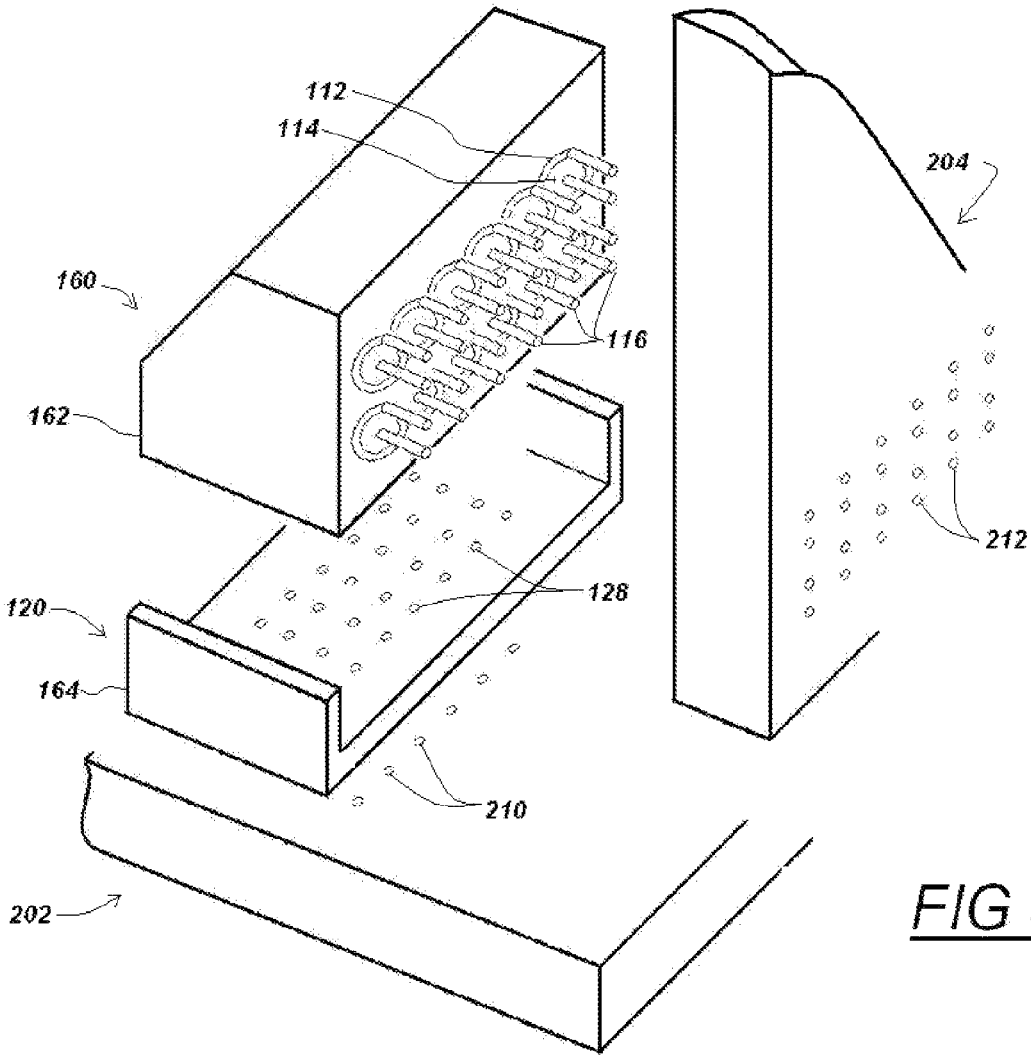
FIG. 3 is an exploded perspective view of a 2×6 connector and connector base according to the disclosure with a mother board and a daughter board.
Figure 4:
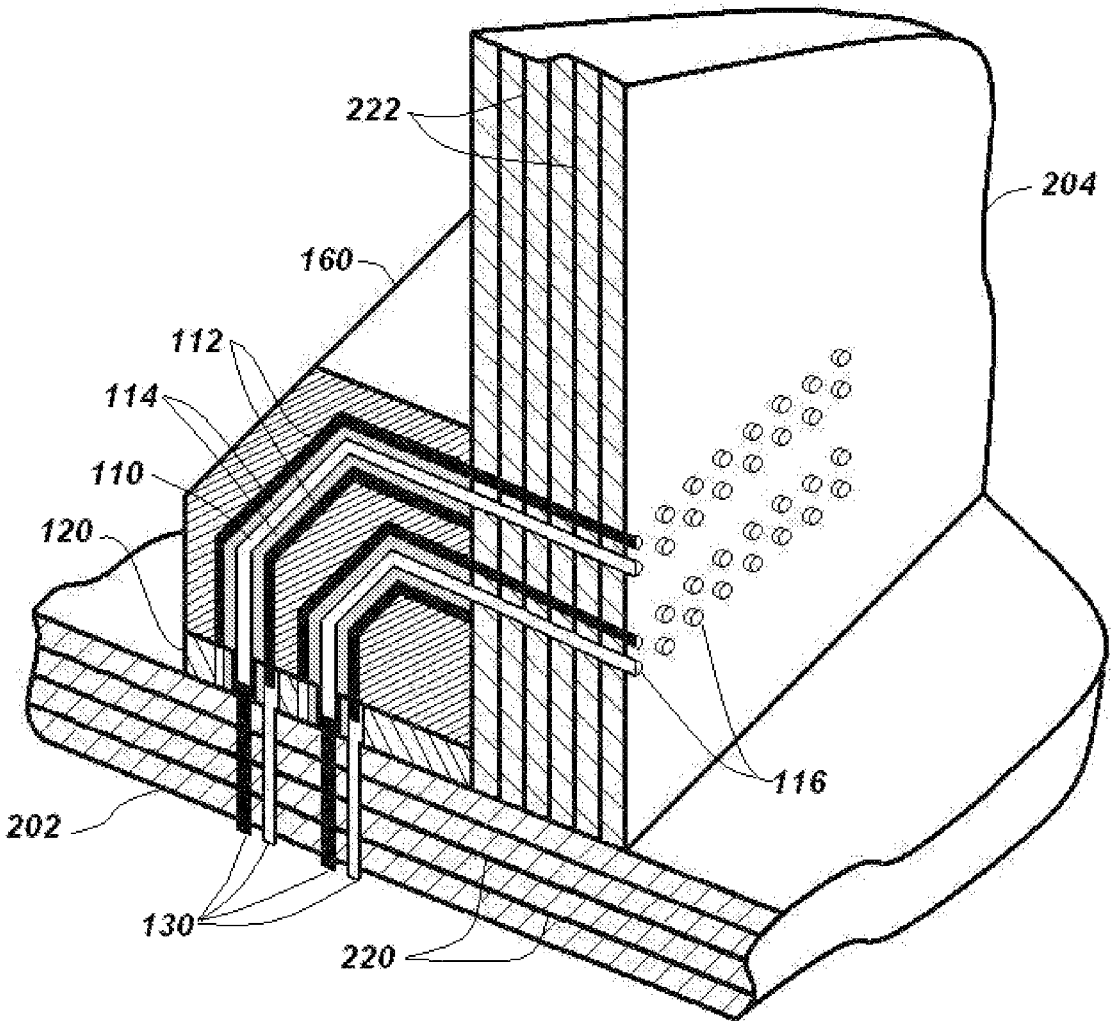
FIG. 4 is a cross-sectional perspective view through the connector, connector base, mother board, and daughter board of FIG. 3.

A second embodiment of the proposed co-axial connector and base structure is shown in more detail in FIGS. 3 and 4. While FIG. 2 shows a 4× version of the disclosed connector, FIGS. 3 and 4 shows a cross-section view though a 2×6 connector 160 and connector base 120. Like connector 100, each signal trace in connector 160 is a co-axial pair line made up of signal conductor 110 and grounding shield 112 separated by insulating tube 114. Each signal trace in the connector base 120 is a co-axial pair line made up of signal conductor 122 and grounding shield 124 separated by insulating cylinder 126. There is no coupling between signal traces, so that an error or defect in one trace will not affect its paired trace. This ground structure ensures minimal radiation loss. Each co-axial pair has its own fifty ohm single-ended characteristic impedance without coupling to other pairs, providing a one-hundred ohm differential impedance for the pair. Like connector 100, each co-axial pair within connector 160 is curved at two forty-five angular degree bends 104.

Pins 130 of connector base 120 are inserted through holes 210 of mother board 202 and soldered by a known method to make connections at the associated layers 220 of the board. Pins 116 of connector 160 are inserted through holes 212 of daughter board 204 and soldered by a known method to make connections at the associated layers 222 of the board. Pins 118 of connector 160 may now be removably inserted into sockets 128 of base 120 to removable connect daughter board 204 to motherboard 202 both mechanically and electrically.

As should be appreciated from the two connector embodiments 100 and 160, the connector structure is scalable according to virtually any practical application and is expandable to any 2n×2m arrangement. All pins, shields and conductors may be made of copper or such a similarly conductive material. Body 162 of the connector 160 and body 164 of connector base 120 may be made from almost any electrically non-conductive material, such as plastic or ceramic, which has mechanical characteristics sufficient for supporting the mechanical connection, and which can withstand the prevailing temperatures of the channel. The insulating tube 114 and insulating cylinder 126 may be any dielectric material of proper insulating characteristics, such as Teflon.

Figure 5A:
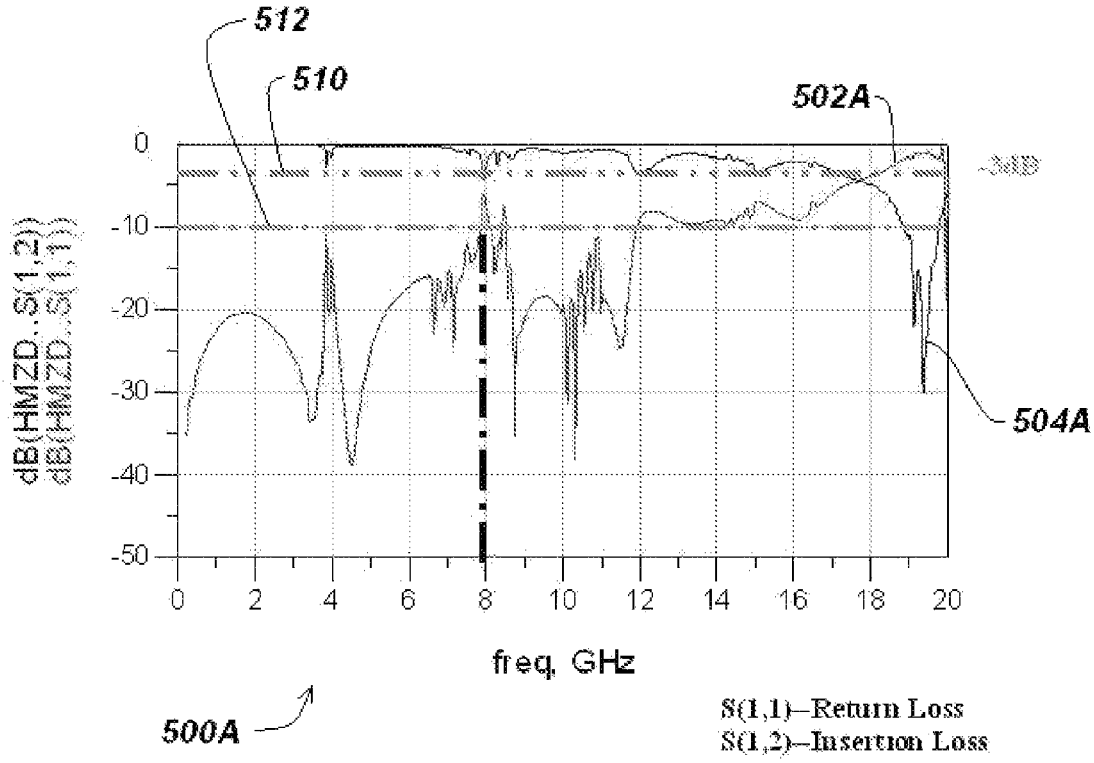
FIG. 5A is an efficiency graph of the differential mode S parameter of a conventional high-speed connector.
Figure 5B:
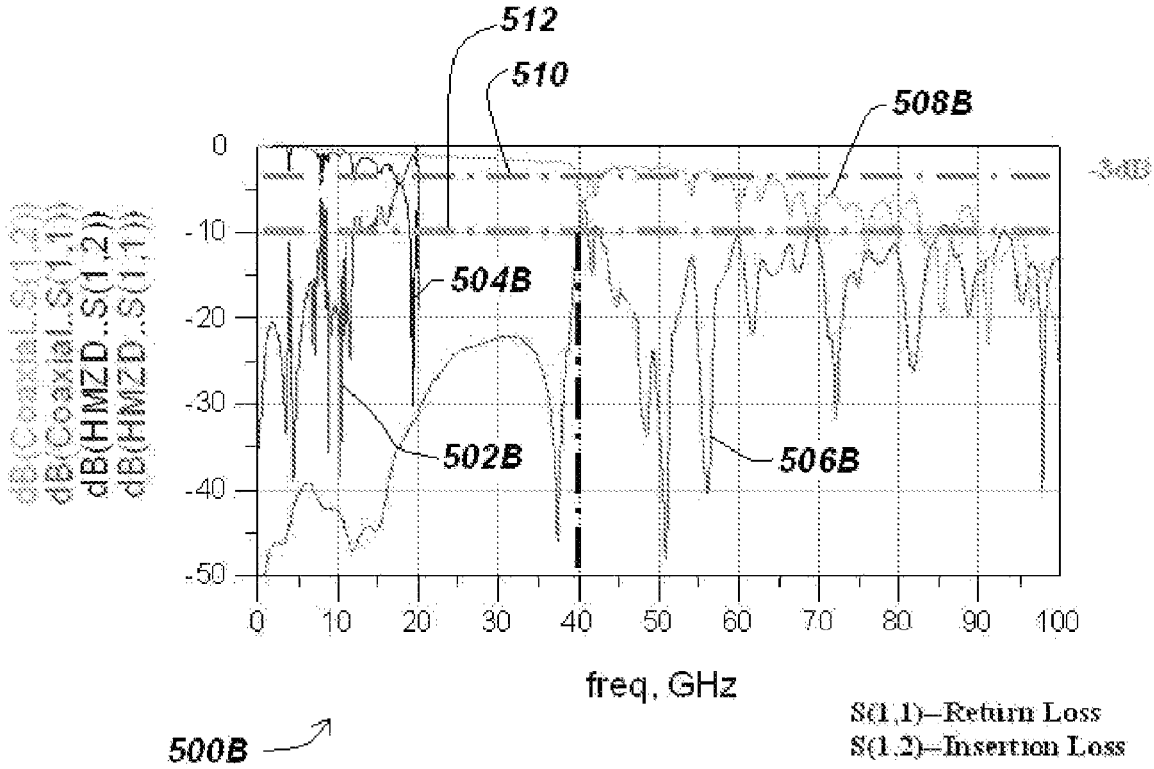
FIG. 5B is an efficiency graph of the differential mode S parameter of a connector according to the disclosure.

A graph 500A of the differential mode S-parameter of one channel is shown in FIG. 5A for a traditional connector and a graph 500B is shown in FIG. 5B for co-axial connector 160. FIG. 5A shows the return loss 502A and insertion loss 504A S-parameter up to 20 GHz for a partial differential in a traditional connector. FIG. 5B shows equivalent S parameters, 502B and 504B, as shown in FIG. 5A, and the return loss 506B and insertion loss 508B S-parameter up to 100 GHz for a differential channel in a co-axial connector according to the disclosure. In both FIGS. 5A and 5B, there is included the −3 dB specification line 510 for insertion loss and the −10 dB specification line 512 for return loss of the S parameter.

The simulation results above show that the −3 dB differential insertion loss and −dB differential loss failure points extend from 8 GHz for a traditional high-speed connector style to 40 GHZ for the disclosed co-axial high-speed connector. The performance of the disclosed high-speed connector is well beyond 40 GHz due to the beneficial properties of the co-axial structure. Furthermore, the disclosed coaxial high-speed connector maintains the return loss of the S-parameter below −20 dB up to almost 39 GHZ, which significantly improves propagation of the high frequency portion of high-speed signal integrity, and ultimately enables transmission to exceed specifications beyond 80 GPbs.

It should be understood that the above disclosures are merely representative and that there are many possible embodiments for a connector for coaxial lines, and that the scope of the invention should only be limited according to the following claims made thereto.

What is claimed is:

1. An electrical connector comprising:

a rigid housing comprising first face having a plurality of first interfaces and a second face having a plurality of second interfaces; and a plurality of conductive coaxial pairs disposed within said rigid housing in substantially parallel curvilinear paths, each conductive coaxial pair comprising a first, a second and a third substantially straight section, wherein said second and said third straight sections are disposed at an approximately forty-five degree angle to a first and second end, respectively, of said first straight portion, each of said conductive coaxial pairs comprising:

a cylindrical electrical conductor extending between one of said first interfaces and one of said second interfaces;

an electrically conductive shield coextensive with and surrounding said conductor; and a rigid dielectric insulator coextensive with and disposed between said conductor and said shield wherein each conductive coaxial pair comprises a 50 ohm single-ended characteristic impedance, said 50 ohm single-ended characteristic impedance providing a 100 ohm differential impedance for each of said conductive coaxial pairs.

2. The connector of claim 1, wherein said conductors and said shields each comprise a connector pin at said first interface and said second interface.

3. The connector of claim 1 wherein said conductors and said shields each comprise one of a connector pin or a connecting socket at each of said interfaces.

4. The connector of claim 3 wherein said first interface and said second interface are disposed at a substantially right angle relative to each other.

5. The connector of claim 3 wherein said conductors and shields each comprise a connector pin at said first interface and said second interface.

6. An electrical connection system comprising:

a connector comprising:

a rigid housing comprising first face having a plurality of first interfaces and a second face having a plurality of second interfaces; and a plurality of conductive coaxial pairs disposed within said rigid housing in substantially parallel curvilinear paths, each conductive coaxial pair comprising a first, a second and a third substantially straight section, wherein said second and said third straight sections are disposed at an approximately forty-five degree angle to a first and second end, respectively, of said first straight portion, each of said conductive coaxial pairs comprising:

a cylindrical electrical conductor extending between one of said first interfaces and one of said second interfaces;

an electrically conductive shield coextensive with and surrounding said conductor; and a rigid dielectric insulator coextensive with and disposed between said conductor and said shield;

wherein each conductive coaxial pair comprises a 50 ohm single-ended characteristic impedance, said 50 ohm single-ended characteristic impedance providing a 100 ohm differential impedance for each of said conductive coaxial pairs; and a connector base comprising:

a second plurality of conductive coaxial pairs, each comprising:

a cylindrical electrical conductor;

an electrically conductive shield coextensive with and surrounding said conductor; and a rigid dielectric insulator coextensive with and disposed between said conductor and said shield; and a rigid housing containing said coaxial pairs in a fixed relationship;

wherein said connector is configured to be permanently coupled to a first printed circuit board and said connector base is configured to be permanently coupled to a second printed circuit board, and said connector and said connector base are configured to be removable coupled together.

7. The connection system of claim 6, wherein said conductors and said shields of said connector and said connector base each comprise a connector pin at said first and second interfaces.

8. The connection system of claim 6 wherein:

said conductors and said shields of said connector comprises each comprise one of a connector pin or a connecting socket at each of said interfaces;

said rigid housing of said connector base comprises a first interface and a second interface, and said conductors and shields thereof each comprise one of a connector pin or a connecting socket at each of said interfaces; and said connector is configured to be permanently coupled to said first printed circuit board at said first interface thereof and said connector base is configured to be permanently coupled to said second printed circuit board at said first interface thereof, and said connector and said connector base are configured to be removeably coupled together at said second interfaces thereof.

9. The connection system of claim 8 wherein said first interface and said second interface of said connector are disposed at a substantially right angle relative to each other, and wherein said first interface and said second interface of said connector base are disposed substantially parallel to each other.

10. The connection system of claim 8 wherein said conductors and shields of said connector and said connector base each comprise a connector pin at said first and second interfaces.

* * * * *